US010463098B2

(12) United States Patent
Kim et al.

(10) Patent No.: US 10,463,098 B2
(45) Date of Patent: Nov. 5, 2019

(54) HAIR EXTENSION DEVICE AND METHOD

(71) Applicant: SHAKE-N-GO FASHION, INC., Port Washington, NY (US)

(72) Inventors: James K. Kim, Manhasset, NY (US); Peter Ough, Manhasset, NY (US); Hye Sun Kim, Port Washington, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 0 days.

(21) Appl. No.: 15/875,253

(22) Filed: Jan. 19, 2018

(65) Prior Publication Data

US 2018/0206571 A1 Jul. 26, 2018

Related U.S. Application Data

(60) Provisional application No. 62/448,557, filed on Jan. 20, 2017.

(51) Int. Cl.
*A41G 5/00* (2006.01)
*A41G 3/00* (2006.01)

(52) U.S. Cl.
CPC ..... *A41G 5/0053* (2013.01); *A41G 3/0016* (2013.01); *A41G 5/004* (2013.01)

(58) Field of Classification Search
CPC ..... A41G 1/04; A41G 3/00; A41G 3/0008; A41G 3/0016; A41G 3/0033; A41G 3/005; A41G 3/0058; A41G 3/0066; A41G 5/00; A41G 5/0006; A41G 5/0013; A41G 5/0026; A41G 5/004; A41G 5/0046; A41G 5/0053; A41G 5/0073
See application file for complete search history.

(56) References Cited

U.S. PATENT DOCUMENTS 2,651,310 A * 9/1953 Selson ..... A41G 5/0093 132/274
D229,240 S * 11/1973 Fox ..... D28/10
4,600,029 A * 7/1986 Ueberschaar ..... A41G 5/0053 132/53
5,044,382 A * 9/1991 Ando ..... A41G 3/0008 132/53
5,551,452 A * 9/1996 Barlow ..... A41G 5/00 132/201
5,778,904 A * 7/1998 Elsner ..... A45D 8/34 132/275

(Continued)

FOREIGN PATENT DOCUMENTS

CA 2 398 739 A1 7/2002
DE 202015000138 * 2/2015

(Continued)

*Primary Examiner* — Tatiana L Nobrega
*Assistant Examiner* — Jennifer F Gill
(74) *Attorney, Agent, or Firm* — Cowan, Liebowitz & Latman, P.C.; Mark Montague; Brian R. Volk

(57) ABSTRACT

A hair extension device is provided that does not prematurely slip or fall out of the user's natural hair when in use. The hair extension device is configured to wrap around a user's natural hair when their natural hair is in a bun or ponytail. The hair extension device includes: a cord member configured in a loop; and an artificial hair extension member coupled to the cord member, the artificial hair extension member comprising a plurality of strands of artificial hair.

4 Claims, 5 Drawing Sheets

(56) References Cited

U.S. PATENT DOCUMENTS

| | | | | |
|---|---|---|---|---|
| 5,899,211 | A * | 5/1999 | Brown | A45D 8/34 132/201 |
| 5,979,462 | A | 11/1999 | Jones | |
| 6,182,672 | B1 * | 2/2001 | Abasta-Douglas | A45D 8/00 132/273 |
| 7,032,602 | B2 | 4/2006 | Chang | |
| 7,174,900 | B2 | 2/2007 | Lane et al. | |
| 7,533,675 | B2 | 5/2009 | Takemura | |
| 9,089,178 | B1 * | 7/2015 | Clarke | A41G 3/00 |
| 2005/0098190 | A1 | 5/2005 | Kim | |
| 2007/0221240 | A1 | 9/2007 | Lee | |
| 2007/0227549 | A1 | 10/2007 | Lee | |
| 2008/0047572 | A1 * | 2/2008 | Park | A41G 3/00 132/53 |
| 2010/0059079 | A1 | 3/2010 | Tokko | |
| 2010/0065078 | A1 | 3/2010 | Reece | |
| 2013/0255707 | A1 | 10/2013 | Oh | |
| 2015/0013710 | A1 | 1/2015 | Buzaglo et al. | |
| 2016/0262482 | A1 * | 9/2016 | Kim | A41G 5/0053 |
| 2016/0338437 | A1 * | 11/2016 | Couch | A41G 3/0041 |
| 2017/0079355 | A1 * | 3/2017 | Kim | A41G 5/004 |

FOREIGN PATENT DOCUMENTS

| | | | |
|---|---|---|---|
| JP | 04-108106 | A | 4/1992 |
| JP | 08-92809 | A | 4/1996 |

* cited by examiner

HAIR EXTENSION DEVICE AND METHOD

CROSS-REFERENCE TO RELATED APPLICATION

This application claims priority to U.S. Provisional Patent Application No. 62/448,557 filed on Jan. 20, 2017, the entire content of which is incorporated herein by reference.

BACKGROUND

1. Field of the Invention

The present application relates generally to hair extensions and in particular to a hair extension device configured to enhance the volume and length of a user's natural hair.

2. Description of Related Art

Hair extensions have been used in the hair styling industry for many years and have recently become popular with ordinary consumers and celebrities alike. Hair extensions are used by consumers to enhance the volume, length and/or color of their natural hair. Hair extensions may be used where the user has thin or thinning hair. Hair extensions can also be used to improve the user's aesthetic appearance with an alternative hair style and/or hair color.

Conventional hair extensions are attached to the user's natural hair by clips or glue. These methods of attachment, while simple to install, are only temporarily effective and the hair extensions tend to slip or fall out over time. Certain high-end hair extensions, which have the most natural and desirable appearance, may even require professional expertise to install, which increases the cost and inconvenience for such hair extensions. Accordingly, ordinary consumers would benefit from hair extensions that are low cost, easy to install and remove, and do not prematurely slip or fall out of the user's natural hair.

SUMMARY OF THE INVENTION

Accordingly, embodiments of the present invention provide a hair extension device. The hair extension device includes: a cord member configured in a loop; and an artificial hair extension member coupled to the cord member, the artificial hair extension member comprising a plurality of strands of artificial hair.

According to further embodiments: the artificial hair extension member is crocheted, glued, or sewn to the cord member; the artificial hair extension member is slidably coupled to the cord member; the artificial hair extension member comprises a first end, a second end and a loop, and wherein the first end and the second end extend through the loop, securing the artificial hair extension member to the cord member; a fastener member is coupled to the artificial hair member below the loop, and wherein the first end and the second end of the artificial hair extension member extend through the fastener member; and the fastener member is selected from the group consisting of a rubber band, thread, and wire.

According to a further embodiments, a hair extension device. The hair extension device includes: a cord member configured in a loop; a mesh member comprising a plurality of interconnected filaments, an inner circumference and an outer circumference, wherein the outer circumference of the mesh member is coupled to the cord member; an artificial hair extension member coupled to at least one of the cord member and the mesh member, the artificial hair extension member comprising a plurality of strands of artificial hair; and a drawstring member coupled to the mesh member within the outer circumference.

According to further embodiments: the artificial hair extension member comprises at least a first artificial hair extension member and a second artificial hair extension member, and wherein the first artificial hair extension member is coupled to the mesh member and the second artificial hair extension member is coupled to the cord member; the artificial hair extension member is slidably coupled to the mesh member; the artificial hair extension member comprises a first end, a second end and a loop, and wherein the first end and the second end extend through the loop, securing the artificial hair extension member to the cord member; a fastener member is coupled to the artificial hair member below the loop, and wherein the first end and the second end of the artificial hair member extend through the fastener member; the drawstring member comprises a clip member and a string member, and wherein the string member comprises a first string member end and a second string member end, and wherein the first string member end and the second string member end extend through the clip member; the clip member is configured to lock the cord member in a tightened configuration, securing the hair extension device to a user's natural hair; and the string member is constructed of an elastic material.

According to a further embodiment, a hair extension device is provided. The hair extension device includes: a cord member comprising a first end and a second end; an artificial hair extension member coupled to the cord member, the artificial hair extension member comprising a plurality of strands of artificial hair; a clip member coupled to the cord member; and a plurality of comb members coupled to the cord member.

According to further embodiments: the first end and the second end of the cord member extend through the clip member in a drawstring configuration; the clip member is configured to lock the cord member in a tightened configuration, securing the hair extension device to the user's natural hair; the comb members are slidably coupled to the cord member; and the artificial hair extension member comprises at least a first artificial hair extension member, a second artificial hair extension member, and a third artificial hair extension member, wherein at least one of the comb members is disposed between the first artificial hair extension member and the second artificial hair extension member, and wherein at least one of the comb members is disposed between the second artificial hair extension member and the third artificial hair extension member.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail. Reference to individual embodiments, whether by number of embodiment or relevant feature of the embodiment, is used for convenience in describing such embodiments. Moreover, reference to individual embodiments does not indicate that any of such embodiments are preferred over any other embodiments. Each individual embodiment, or any feature of each embodiment, may be combined with any other individual embodiment, whether or not expressly stated.

Embodiments of the invention described herein provide a hair extension device that can be coupled to a user's natural hair. The hair extension device is low cost, easy to install and remove, and does not prematurely slip or fall out of the user's natural hair when in use. The hair extension device is configured to wrap around a user's natural hair when their natural hair is in a bun or ponytail. The hair extension device includes bundles of artificial hair coupled to a surface thereof that the user can style and modify to their preference. The hair extension device includes components that keep the hair extension device tightly secured to the user's natural hair. In certain embodiments, the hair extension device includes a drawstring that is configured to pull tightly around the user's natural hair, securing the hair extension device to the user's natural hair. In certain embodiments, the hair extension device includes combs that insert into the user's natural hair, securing the hair extension device to the user's natural hair. According to the embodiments described herein, a hair extension device is provided that enables a user to add hair extensions to their natural hair without the high-cost and inconvenience of conventional devices and methods.

The phrase "artificial hair," as used herein, refers to synthetic hair products as well as human hair or animal hair and combinations thereof. The artificial hair may be embodied in various traditional hair colors, such as black, brown, blonde, and red, as well as non-traditional hair colors, such as blue, green, and purple, and combinations thereof, including individual strands of hair having two or more colors.

The term "user," as used herein, refers to any purchaser of the hair extension device configured according to any of the embodiments disclosed herein, including, but not limited to, individual members of the public, wholesale distributors, retail merchants, manufacturers, importers and exporters of the wig and related components of the wig.

Figure 1:
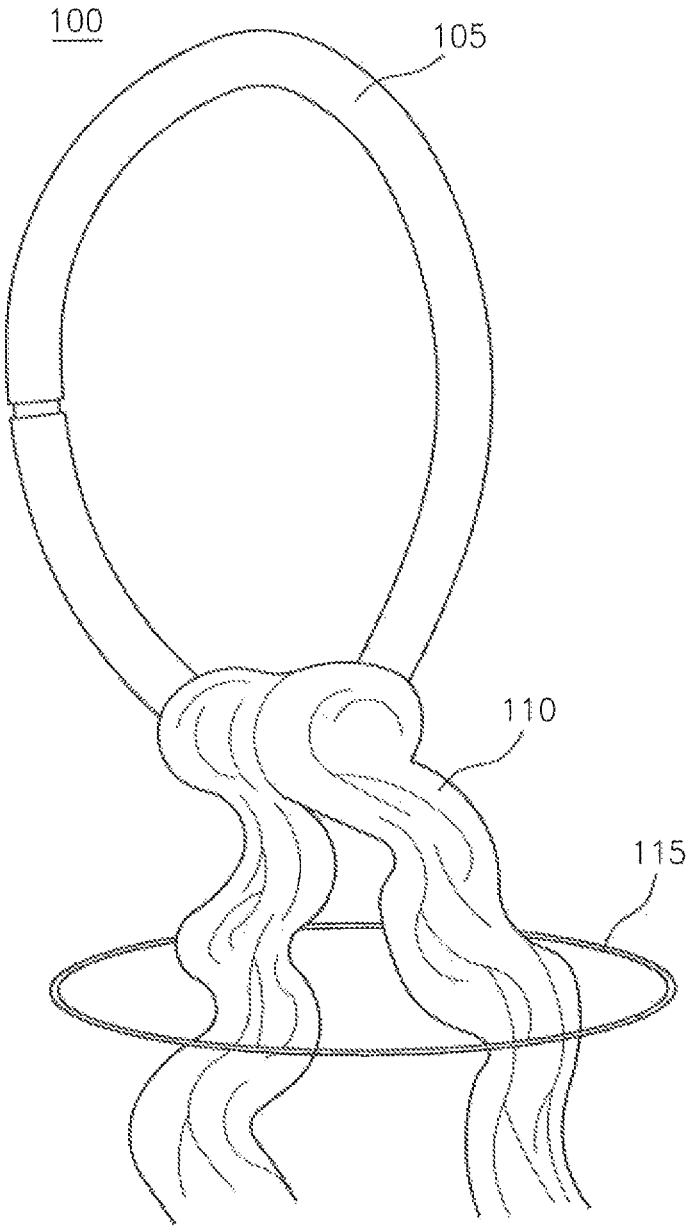
FIG. 1 illustrates a hair extension device, according to a first embodiment of the present invention.

FIG. 1 illustrates a hair extension device 100 according to a first embodiment of the present invention. The hair extension device 100 includes a cord member 105 and an artificial hair extension member 110. In certain embodiments, the cord member 105 is a rubber band, hair tie band, or other suitable device, preferably constructed of an elastic material. The cord member 105 is configured in a loop. The cord member 105 can be made with varying lengths and thicknesses, according to the user's preference. The artificial hair extension member 110 is constructed of multiple strands of artificial hair. The strands of artificial hair can be made with varying length, thickness and color, according to the user's preference. The artificial hair extension member 110 is coupled to the cord member 105. In certain embodiments, the artificial hair extension member 110 is slidably coupled to the cord member 105 so that the position of the artificial hair extension member 110 can be adjusted.

For example, the artificial hair extension member 110 may be crocheted, glued, sewn, or other suitable method of attachment, and combinations thereof, to the cord member 105. In certain embodiments, when the artificial hair extension member 110 is crocheted to the cord member 105, additional methods of coupling the artificial hair extension member 110 thereto may be utilized. For example, the artificial hair extension member 110 may be grasped at the mid-point of the length of the artificial hair extension member 110 and folded in half. At the mid-point, a loop is created that can be used to crochet the artificial hair extension member 110 to the cord member 105. That is, the ends of the artificial hair extension member 110 extend through the loop. In certain embodiments, the loop is twisted at least 180 degrees so that the hair extension member 110 crosses over itself. In certain embodiments, the loop is twisted at least 360 degrees, 540 degrees, or 720 degrees. In certain embodiments, without the twist, the artificial hair extension member 110 otherwise does not cross over itself.

In order to further secure the artificial hair extension member 110 to the cord member 105, a fastener member 115 is coupled to the artificial hair extension member 110 below the loop. The fastener member 115 is configured in a loop and can be slid up and down on the length of the artificial hair extension member 110 in order to make the loop smaller or larger, respectively. The ends of the hair extension member 110 extend through the fastener member 115. In certain embodiments, the fastener member 115 is a rubber band, string, wire, or other suitable device, including the product marketed as the Flexi-Lock™, configured to secure the artificial hair extension member 110 to the fastener member 115.

In certain embodiments, the cord member 105 is partially covered with the multiple artificial hair extension members 110. That is, multiple artificial hair extension members 110 are disposed around at least a portion of the cord member 105. In certain embodiments, there is a sufficient number of the artificial hair extension members 110 to cover the entire cord member 105. The hair extension device 100 is coupled to the user's natural hair by wrapping the cord member 105 around the user's ponytail or bun. Once the hair extension device 100 is secured to the user's natural hair, the artificial hair extension members 110 can be styled according to the user's preference. For example, the artificial hair extension members 110 can be left as a pony tail or styled in a bun. The hair extension device 100 improves the user's appearance by adding volume and length to the user's natural hair.

Figure 2:
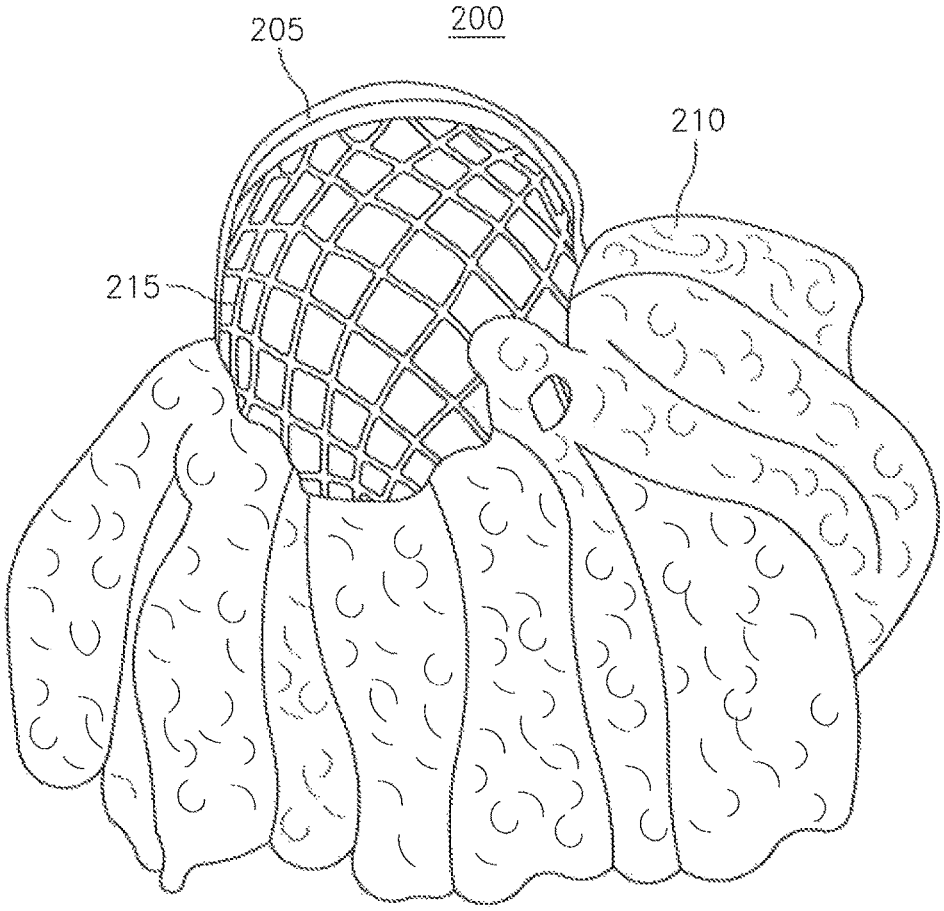
FIGS. 2 and 3 illustrate a hair extension device, according to a second embodiment of the present invention.
Figure 3:
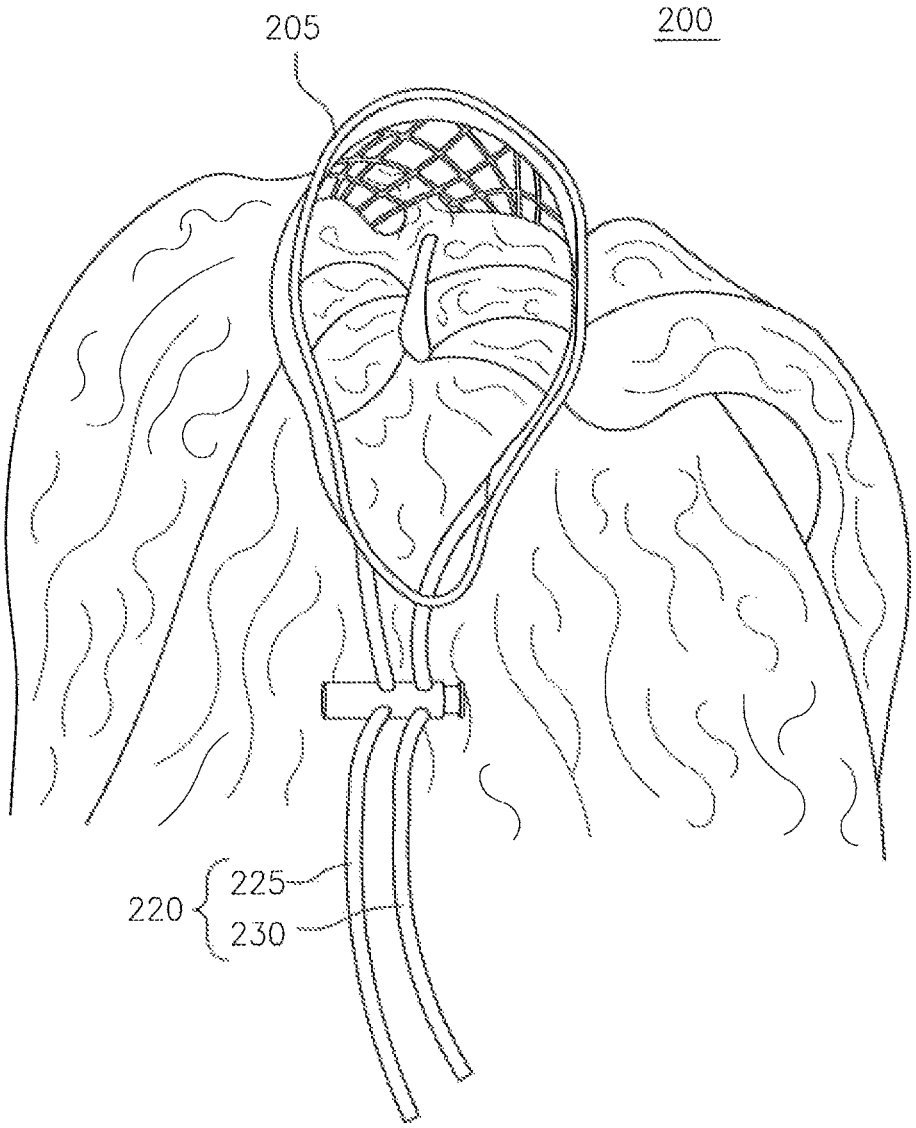

FIGS. 2 and 3 illustrate a hair extension device 200 according to a second embodiment of the present invention. The hair extension device 200 includes an cord member 205, an artificial hair extension member 210, a mesh member 215, and a drawstring member 220. The cord member 205 is configured in a loop. In certain embodiments, the cord member 205 is a rubber band, hair tie band, or other suitable device constructed of an elastic material. The cord member 205 can be made with varying lengths and thicknesses according to the user's preference. The artificial hair extension member 210 is constructed of multiple strands of artificial hair. The strands of artificial hair can be made with varying length, thickness and color according to the user's preference. The artificial hair extension member 210 is coupled to the cord member 205 and/or to the mesh member 215.

For example, the artificial hair extension member 210 may be crocheted, glued, sewn, etc. to the cord member 205 and/or to the mesh member 215. In certain embodiments, when the artificial hair extension member 210 is crocheted to the cord member 205, additional methods of coupling the artificial hair extension member 210 thereto may be utilized.

For example, the artificial hair extension member 210 may be grasped at the mid-point of the length of the artificial hair extension member 210 and folded in half. At the mid-point, a loop is created that can be used to crochet the artificial hair extension member 210 to the cord member 205. In certain embodiments, the loop is twisted at least 180 degrees so that the hair extension member 210 crosses over itself. In certain embodiments, the loop is twisted at least 360 degrees, 540 degrees, or 720 degrees. In certain embodiments, without the twist, the artificial hair extension member 210 otherwise does not cross over itself.

In order to further secure the artificial hair extension member 210 to the cord member 205, a fastener member (not shown) is attached to the artificial hair extension member 210 below the loop. The fastener member can be slid up and down on the length of the artificial hair extension member 210 in order to make the loop smaller or larger, respectively. The fastener member can be a rubber band, string, wire, or other suitable item for securing the artificial hair extension member 210, including the product marketed as the Flexi-Lock™.

The mesh member 215 includes multiple interconnected filaments. The filaments are constructed of a flexible and elastic material. The mesh member 215 includes an inner circumference and an outer circumference, which refer to two integrated regions of the mesh member 215. The outer circumference of the mesh member 215 is coupled to the cord member 205. For example, the filaments on the outer circumference of the mesh member 215 wrap around the cord member 205. In other words, the cord member 205 is woven through the openings between the filaments of the mesh member 215. The artificial hair extension member 210 may be coupled to the mesh member 215 and/or the cord member 205. In certain embodiments, the artificial hair extension member 210 is slidably coupled to the mesh member 215 and/or the cord member 205 so that the position of the artificial hair extension member 210 thereon may be adjusted according to the user's preference.

In certain embodiments, the cord member 205 is partially covered with multiple artificial hair extension members 210. In certain embodiments, there are a sufficient number of the artificial hair extension members 210 to cover the entire cord member 205. In certain embodiments, the mesh member 215 is partially covered with the artificial hair extension members 210. In certain embodiments, there are a sufficient number of the artificial hair extension members 210 to cover the entire mesh member 215.

The drawstring member 220 includes a clip member 225 and a string member 230. The string member 230 is constructed of string, thread, rubber band, or other suitable device, preferably constructed of an elastic material. The string member 230 is woven along an inner surface and an outer surface of the mesh member 205. The string member 230 includes two ends. The two ends of the string member 230 are inserted through the clip member 225. The clip member 225 is used to tighten and secure the string member 230. That is, the clip member 225 clamps to the string member 230 and may be slidably adjusted up and down the string member 230 in order to tighten and loosen, respectively, the string member 230. The hair extension device 200 is secured to the user's natural hair by tightening the drawstring member 220. The cord member 205 is wrapped around the user's natural hair, such as a bun in the user's natural hair, and the string member 230 is tightened around the bun. The clip member 230 is configured to lock the string member 230 in a tightened configuration, securing the hair extension device 200 to the user's natural hair.

Figure 4:
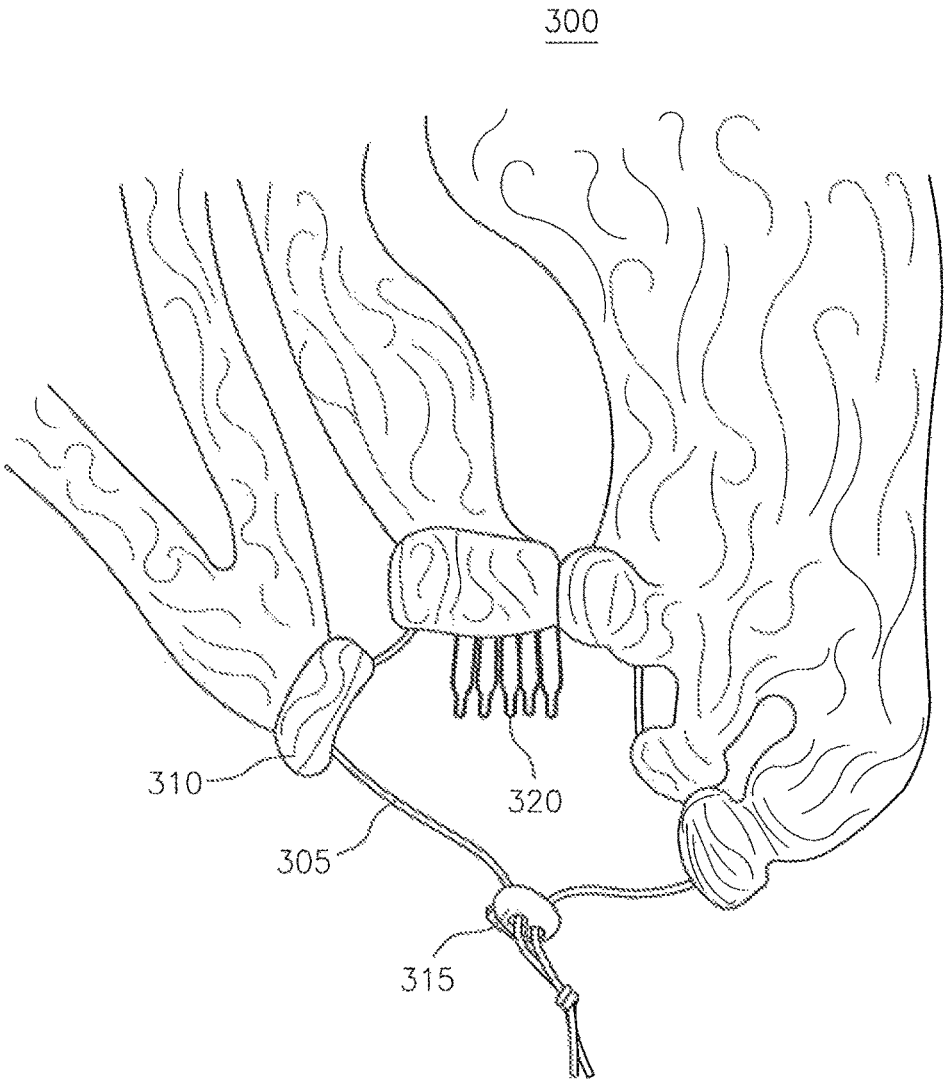
FIGS. 4 and 5 illustrate a hair extension device, according to a third embodiment of the present invention.
Figure 5:
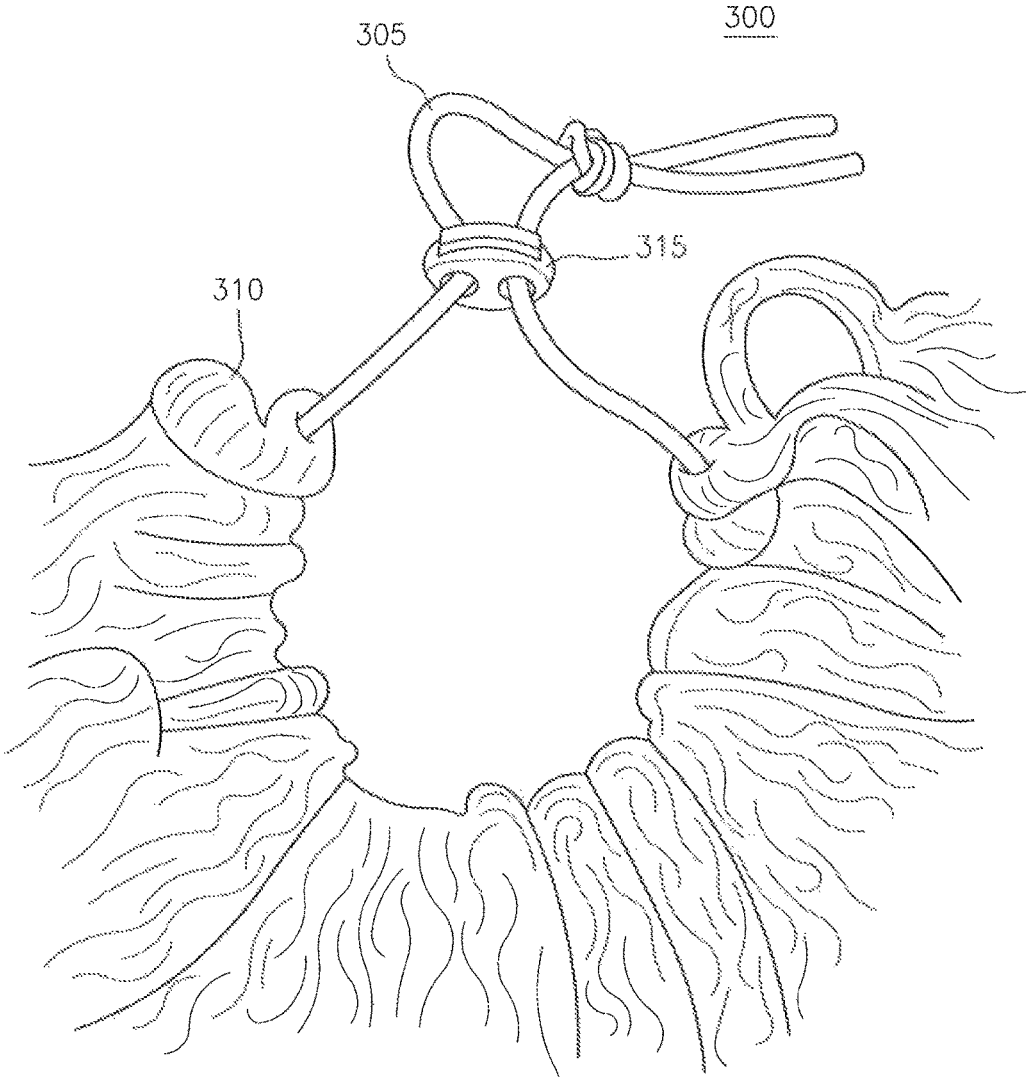

FIGS. 4 and 5 illustrate a hair extension device 300 according to a third embodiment of the present invention. The hair extension device 300 includes a cord member 305, an artificial hair extension member 310, a clip member 315, and comb members 320. The cord member 305 includes two ends. In certain embodiments, the cord member is thread, a rubber band, hair tie band, or other suitable device, preferably constructed of an elastic material. The cord member 305 can be made with varying lengths and thicknesses according to the user's preference. The artificial hair extension member 310 is constructed of multiple strands of artificial hair. The strands of artificial hair can be made with varying length, thickness and color, according to the user's preferences.

The artificial hair extension member 310 is coupled to the cord member 305. For example, the artificial hair extension member 310 may be crocheted, glued, sewn, etc. to the cord member 305. In certain embodiments, when the artificial hair extension member 310 is crocheted to the cord member 305, additional methods of coupling the artificial hair extension member 310 thereto may be utilized. For example, the artificial hair extension member 310 may be grasped at the mid-point of the length of the artificial hair extension member 310 and folded in half. At the mid-point, a loop is created that can be used to crochet the artificial hair extension member 310 to the cord member 305. In order to further secure the artificial hair extension member 310 to the cord member 305, a fastener member (not shown) is attached to the artificial hair extension member 310 below the loop. The fastener member can be slid up and down on the length of the artificial hair extension member 310 in order to make the loop smaller or larger, respectively. The fastener member can be a rubber band, string, wire, or other suitable item for securing the artificial hair extension member 310, including the product marketed as the Flexi-Lock™.

In certain embodiments, the cord member 305 is partially covered with multiple artificial hair extension members 310. In certain embodiments, there are a sufficient number of the artificial hair extension members 310 to cover the entire cord member 305.

The cord member 305 includes two ends. The two ends of the cord member 305 are inserted through the clip member 315 in a drawstring configuration. The clip member 315 is used to tighten and secure the cord member 305. That is, the hair extension device 300 is secured to the user's natural hair by wrapping the cord member 305 around the user's natural hair, such as a bun in the user's natural hair, and the cord member 305 is tightened around the bun. The clip member 315 is configured to lock the cord member 305 in a tightened configuration, securing the hair extension device 300 to the user's natural hair.

The comb members 320 are coupled to the cord member 305. In certain embodiments, the comb members 320 are slidably coupled to the cord member 305 such that the position of the comb members 320 can be adjusted by the user, according to their preference. The comb members 320 are inserted into the user's natural hair and secure the hair extension device 300 to the user's natural hair. The comb members 320 prevent the hair extension device 300 from sliding and/or shifting on the user's head once the user has attached the hair extension device 300 to their natural hair.

In certain embodiments, the comb members 320 are disposed between multiple hair extension members 320. For example, the artificial hair extension member 310 includes at least a first artificial hair extension member, a second artificial hair extension member, and a third artificial hair extension member. At least one of the comb members 320 is disposed between the first artificial hair extension member and the second artificial hair extension member, and at least one of the comb members 320 is disposed between the second artificial hair extension member and the third artificial hair extension member. Furthermore, multiple hair extension members 310 may be disposed between one or more of the comb members 320.

A method of securing a hair extension device, which includes the hair extension device 100, the hair extension device 200, and the hair extension device 300 configured according to the embodiments described above, to a user's natural hair is also provided. The method includes providing a hair extension device including a cord member and artificial hair extension members. The method includes styling a user's hair according to a predetermined style, including a bun, a pony tail or other suitable style. The artificial hair extension members are then coupled to the cord member and the cord member is wrapped around the user's hair.

In certain embodiments, the cord member is embodied in a drawstring configuration. In the drawstring configuration, the method further includes pulling the cord member tight around the user's hair in order to secure the hair extension device to the user's hair. The artificial hair extension members are then styled according to the user's preference. For example, the artificial hair extension members can be wrapped around the user's bun or pony tail and secured with, for example, bobby pins, clips or other suitable items.

As described herein, embodiments of the invention provide a hair extension device that is low cost, easy to install and remove, and does not prematurely slip or fall out of the user's natural hair when in use. The hair extension device is configured to wrap around a user's natural hair when their natural hair is in a bun or ponytail. The hair extension device includes bundles of artificial hair coupled to a surface thereof that the user can style and modify to their preference. The hair extension device includes components that keep the hair extension device tightly secured to the user's natural hair. Accordingly, the embodiments of the hair extension device described herein enable a user to add hair extensions to their natural hair without the high-cost and inconvenience of conventional devices and methods.

While embodiments of the invention have been shown and described with reference to certain embodiments thereof, it will be understood by those skilled in the art that various changes in form and details may be made therein without departing from the spirit and scope of the invention and equivalents thereof.

What is claimed is:

1. A hair extension device, comprising:

a cord member configured in a loop;

a mesh member comprising a plurality of interconnected filaments, an inner surface and an outer surface, wherein the cord member is woven through openings between the filaments of the mesh member;

an artificial hair extension member comprising a plurality of strands of artificial hair; and a drawstring member located adjacent to and separate from the cord member, the drawstring member comprising a string member and a clip member, wherein the string member is woven along the inner surface and the outer surface of the mesh member, wherein the artificial hair extension member comprises at least a first artificial hair extension member and a second artificial hair extension member, and wherein the first artificial hair extension member is coupled to the mesh member and the second artificial hair extension member is coupled to the cord member, wherein the first artificial hair extension member is slidably coupled to the filaments of the mesh member and wherein the second artificial hair extension member comprises a first end, a second end, and a hair extension loop, and wherein the first end and the second end extend through the hair extension loop, securing the second artificial hair extension member to the cord member.

2. The hair extension device according to claim 1, wherein the string member comprises a first string member end and a second string member end, and wherein the first string member end and the second string member end extend through the clip member.

3. The hair extension device according to claim 1, wherein the clip member is configured to lock the string member in a tightened configuration, securing the hair extension device to a user's natural hair.

4. The hair extension device according to claim 3, wherein the string member is constructed of an elastic material.

* * * * *